US005963168A

United States Patent [19]

Brennan

[11] Patent Number: 5,963,168

[45] Date of Patent: Oct. 5, 1999

[54] ANTENNA HAVING DOUBLE-SIDED PRINTED CIRCUIT BOARD WITH COLLINEAR, ALTERNATING AND OPPOSING RADIATING ELEMENTS AND MICROSTRIP TRANSMISSION LINES

[75] Inventor: Michael L. Brennan, Howell, N.J.

[73] Assignee: Radio Frequency Systems, Inc., Marlboro, N.J.

[21] Appl. No.: 08/787,210

[22] Filed: Jan. 22, 1997

[51] Int. Cl.[6] ..... H01Q 1/38

[52] U.S. Cl. ..... 343/700 MS; 343/790

[58] Field of Search ..... 343/700 MS, 790, 343/791, 795, 702, 906; H01Q 1/38

[56] References Cited

U.S. PATENT DOCUMENTS

| | | | |
|---|---|---|---|
| 3,031,668 | 4/1962 | Bryson | 343/790 |
| 3,153,239 | 10/1964 | Adams | 343/791 |
| 3,995,277 | 11/1976 | Olyphant, Jr. | 343/846 |
| 4,864,318 | 9/1989 | Iwasaki et al. | 343/795 |
| 4,893,129 | 1/1990 | Kodera et al. | 343/700 |
| 5,339,089 | 8/1994 | Dienes . | |
| 5,473,336 | 12/1995 | Harman et al. | 343/790 |
| 5,589,843 | 12/1996 | Meredith et al. | 343/820 |
| 5,757,324 | 5/1998 | Helms et al. | 343/700 |
| 5,764,193 | 6/1998 | Uchino et al. | 343/795 |

FOREIGN PATENT DOCUMENTS

| | | |
|---|---|---|
| 8799291 | 5/1992 | Australia . |
| 0487053 | 5/1992 | European Pat. Off. . |
| 487053 | 5/1992 | European Pat. Off. . |
| 4225298 | 2/1994 | Germany . |
| 4308604 | 9/1994 | Germany . |
| 9638882 | 12/1996 | WIPO . |

OTHER PUBLICATIONS

"Phased Array Antenna System" by Sato Mitsuhisa, Patent Abstracts of Japan, vol. 096, No. 010, Oct. 31, 1996 and JP 08 148931 A (Tech Res & Amp; Dev Inst Of Japan Def Agency; NEC Corp), Jun. 7, 1996.

"A Vertical Antenna Made of Transposed Sections Of Coaxial Cable", by H.A. Wheeler, IRE Convention Record, Vol. 4, Part 1, 1956, pp. 160–164.

"New 5 dBi Omni Could be the perfect antenna for your subscriber or base station installations" by Cushcraft Corporation, Specifications, 2 pages, as mentioned on p. –2–of the application filed Jan 22, 1997.

"Linearly Polarized Microstrip Antennas", by A.G. Derneryd, IEEE Transactions on Antennas and Propagation, Nov. 1976, pp. 846–851.

"A High–Gain Omnidirectional Antenna Made of a Printed Element", by Makoto Ono et al., The Transactions of the IECE Of Japan, vol. E 63, No. 1, Jan. 1, 1980, pp. 58–60.

*Primary Examiner*—Don Wong
*Assistant Examiner*—Tho Phan
*Attorney, Agent, or Firm*—Ware, Fressola, Van Der Sluys & Adolphson LLP

[57] ABSTRACT

The present invention provides a microstrip collinear antenna having cable connector assembly means and a collinear microstrip printed circuit board means. The cable connector assembly means responds to a radio signal, for providing a cable connector assembly radio signal. The collinear microstrip printed circuit board means responds to the cable connector assembly radio signal, for providing a collinear microstrip printed circuit board radio signal. The microstrip line collinear antenna is constructed with a number of one half λ printed circuit board elements on both sides of a double-sided board. These one half λ sections are the radiators. On the other side of the board opposite each radiator is a respective section of corresponding microstrip transmission lines to provide radio frequency power to each radiating element. The microstrip line collinear antenna has the following advantages over the prior art antennas: it achieves shorter length due to close physical spacing of radiators, it maintains consistent pattern and impedance performance across the operating frequency range, it allows for accurate and consistent manufacturing through the use of advanced printed circuit board materials, allows for center feed design to achieve high-gain broadband operation, and it allows cost reduction with printed circuit board materials.

17 Claims, 14 Drawing Sheets

(MICROSTRIP COLLINEAR ANTENNA)

(FRONT VIEW OF INNER COMPLETE ASSEMBLY)

(REAR VIEW OF INNER COMPLETE ASSEMBLY)

(MICROSTRIP COLLINEAR ANTENNA)

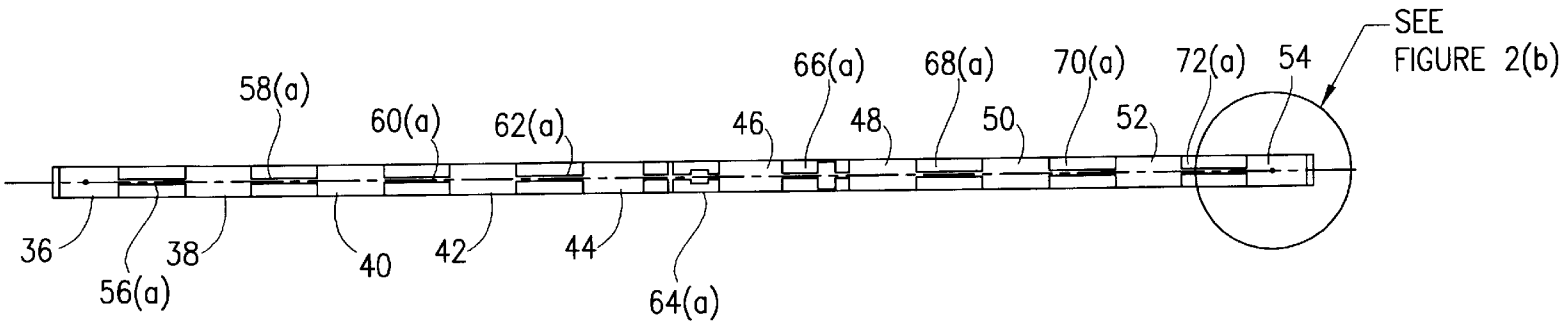
FIGURE 2(a)
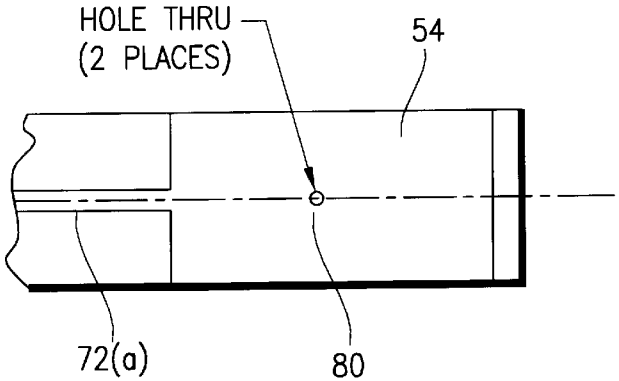
FIGURE 2(b)
FIG. 2
(PC BOARD FABRICATION DRILL DRAWING)

(CABLE CONNECTOR ASSEMBLY)

(CONNECTOR)

(CABLE ADAPTER SUBASSEMBLY)

(OUTER CONDUCTOR ADAPTER)

(CABLE STRIPPING)

(POTTING ASSEMBLY)

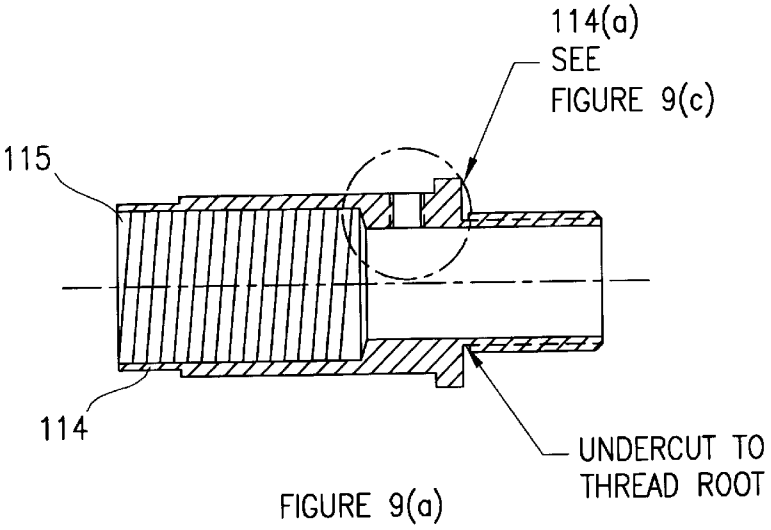
FIGURE 9(a)
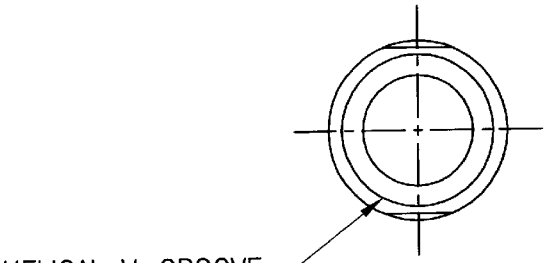
FIGURE 9(b)
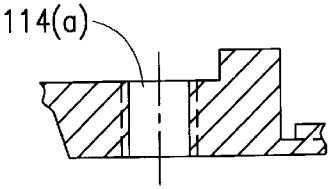
FIGURE 9(c)
FIG. 9
(SUPPORT)

(COMPLETE ASSEMBLY)

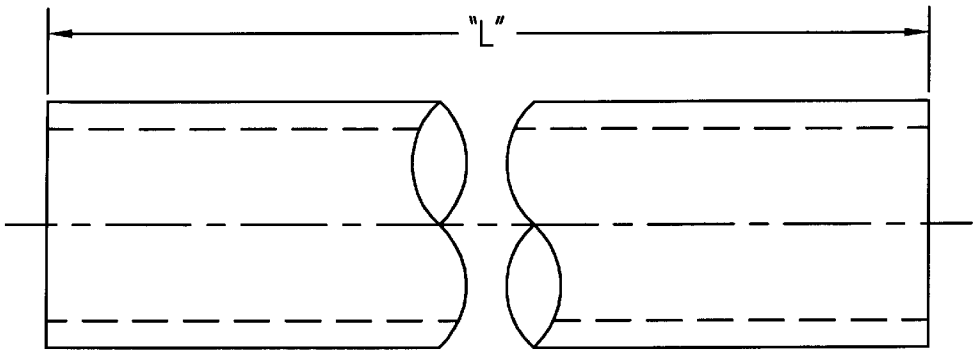
FIG. 11(a)
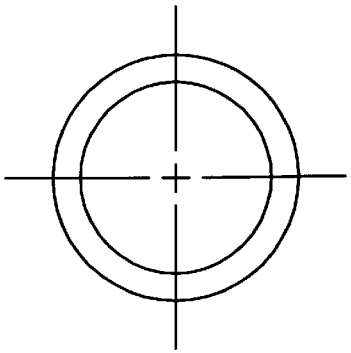
FIG. 11(b)
FIG. 11
(RADOME)
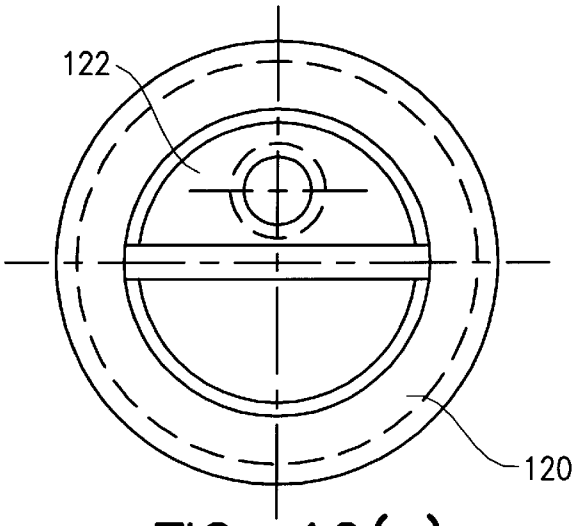
FIG. 12(a)
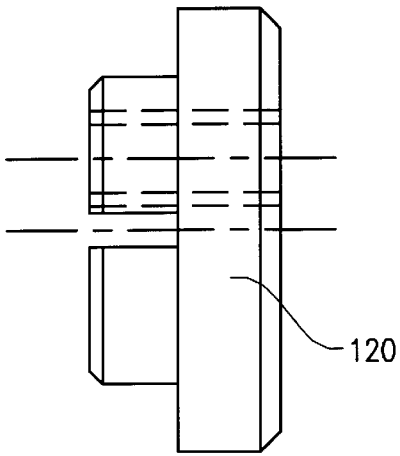
FIG. 12(b)
FIG. 12
(RADOME TOP CAP)

ANTENNA HAVING DOUBLE-SIDED PRINTED CIRCUIT BOARD WITH COLLINEAR, ALTERNATING AND OPPOSING RADIATING ELEMENTS AND MICROSTRIP TRANSMISSION LINES

BACKGROUND OF THE INVENTION

1. Field Of The Invention

The present invention relates generally to antennas, and more particularly relates to a microstrip collinear antenna.

2. Description Of The Prior Art

Omnidirectional personal communication service (PCS) antennas are increasingly becoming important antennas in the cellular communication industry. Omnidirectional personal communication service (PCS) antennas are small, lightweight, easily affixed to buildings and other structures in and around cities and suburban communities, and more aesthetically pleasing when compared to the otherwise huge radio antenna towers that have been known in the cellular communication industry.

There are many known omnidirectional personal communication service (PCS) antennas in the prior art. In general, omnidirectional PCS antennas are constructed as sleeve dipoles or wire antennas with element spacings of 0.75 λ in order to achieve proper radiation patterns. A traditional collinear design would require transposed coaxial ½ λ element sections directly connected. In addition, these antennas have narrow patterns and impedance bandwidths.

In particular, U.S. Pat. No. 3,031,668 shows in FIGS. 1–2 and describes a dielectric loaded collinear vertical dipole antenna having a sequence of coaxial cable sections 12–18, a ¼ λ coaxial cable bottom section 11, a ¼ λ coaxial cable bottom section 21, radially disposed conductive spokes 19, an antenna feed cable 20, and a signal translating circuit 50.

An IRE Convention Record, Volume 4, Part 1 (1956), entitled "A Vertical Antenna Made of Transposed Sections of Coaxial Cable", by H. Wheeler, shows in FIGS. 1(*a*)–(*b*) and describes a vertical antenna having a series of solid dielectric coaxial cables with inner and outer conductors transposed at every junction. Each section has an effective length of ½ λ in the solid dielectric coaxial cable, so the radiating gaps between the sections are all excited in the same polarity.

One known company in the industry has a PCS antenna described in a readily available specification. The Cushcraft PCS antenna appears to be a 6 dBd low profile omnidirectional antenna that operates in a frequency range of 1850–1990 Megahertz (Mhz), although the specification does not make clear the design thereof.

The prior art omnidirectional antennas suffer from a number of disadvantages, including having inconsistent pattern performance across their operating range as shown in FIGS. 16–18, requiring large element spacings and longer physical lengths, being difficult to assemble and labor intensive, and being very expensive and cost prohibitive.

SUMMARY OF THE INVENTION

The present invention provides a microstrip collinear antenna having cable connector assembly means and a collinear microstrip printed circuit board means.

The cable connector assembly means responds to a radio signal, for providing a cable connector assembly radio signal. The collinear microstrip printed circuit board means responds to the cable connector assembly radio signal, for providing a collinear microstrip printed circuit board radio signal.

In one embodiment, the microstrip line collinear antenna is constructed with a number of half λ printed circuit board elements on one side of a double-sided board. These half λ sections are the radiators. On the other side of the board opposite each radiator is a section of microstrip transmission lines to provide radio frequency power to each radiating element.

The microstrip line collinear antenna has the following advantages over the prior art antennas: it achieves shorter length due to close physical spacing of radiators, it maintains consistent pattern and impedance performance across the operating frequency range, it allows for accurate and consistent manufacturing through the use of advanced printed circuit board materials, allows for center feed design to achieve high-gain broadband operation, and it allows cost reduction with printed circuit board materials.

Other advantages will become apparent to those skilled in the art from the following detailed description read in conjunction with the appended claims and drawings attached hereto.

BRIEF DESCRIPTION OF THE DRAWINGS

The drawings, not drawn to scale, include:

FIG. 2 includes FIG. 2(*a*) which are a diagram of a PC board fabrication drill drawing of the microstrip collinear antenna shown in FIG. 1, and includes FIG. 2(*b*) which is an enlargement of an end radiating element of the PC board fabrication drill drawing shown in FIG. 2(*a*).

FIG. 6(*d*) shows a cross-section of the outer conductor adaptor body 106 along lines Z–Z'.

FIG. 9 includes FIGS. 9(*a*)–(*c*) which are diagrams of a support of the potting assembly shown in FIG. 8.

FIG. 11 includes Figures 11(*a*)–(*b*) which are diagrams of a radome of the complete assembly shown in FIG. 10.

FIG. 12 includes FIGS. 12(*a*)–(*b*) which are diagrams of a radome top cap of the complete assembly shown in FIG. 10.

BEST MODE FOR CARRYING OUT THE INVENTION

Figures 1, 1A, 1B:
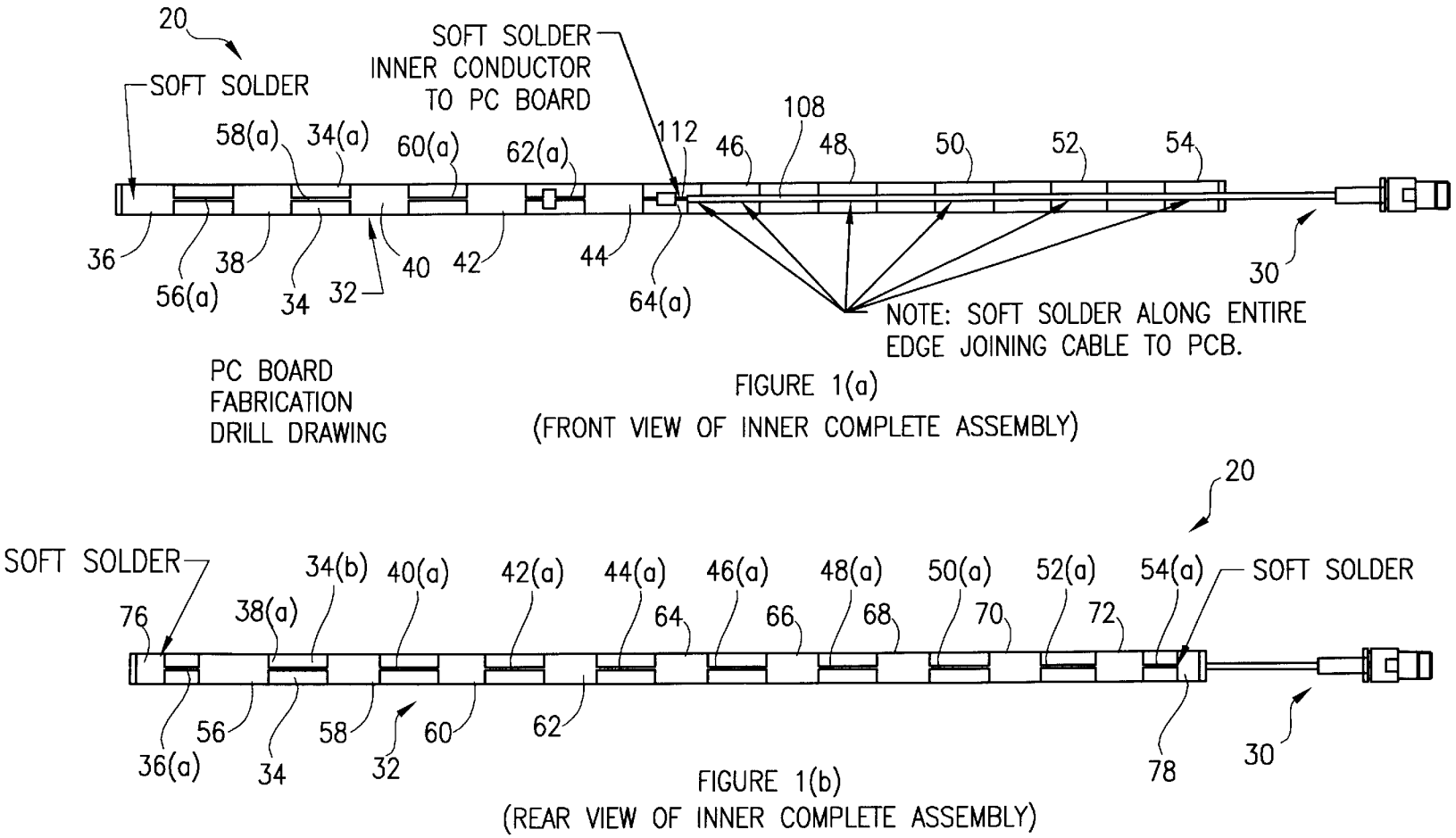
FIG. 1 shows a diagram of a microstrip collinear antenna which is the subject matter of the present application, including respectively in FIGS. 1(*a*)–(*b*) a front and rear view of an inner complete assembly thereof of the microstrip collinear antenna.

FIGS. 1, 1(*a*) and 1(*b*) show a diagram of a microstrip collinear antenna generally indicated as 20.

The microstrip collinear antenna 20 comprises cable connector assembly means generally indicated as 30 and a collinear microstrip printed circuit board means generally indicated as 32. The cable connector assembly means 30 responds to a radio signal, for providing a cable connector assembly radio signal. The collinear microstrip printed circuit board means 32 responds to the cable connector assembly radio signal, for providing a collinear microstrip printed circuit board radio signal. As shown, the microstrip collinear antenna 20 has the decoupling spacing of 2.328 inches and chosen to limit undesirable current flowing between the coaxial cable (not shown) and the collinear 15 microstrip printed circuit board means 32.

The collinear microstrip printed circuit board means 32 has a double-sided circuit board generally indicated as 34 having a front side 34(*a*) and a rear side 34(*b*). The collinear microstrip printed circuit board means 32 has a first plurality of one half λ printed circuit board radiating elements 36, 38, 40, 42, 44, 46, 48, 50, 52, 54 collinearly arranged on one side 34(*a*) of the double-sided board 34. The collinear microstrip printed circuit board means 32 also has a respective section of microstrip transmission lines referred to as 36(*a*), 38(*a*), 40 (*a*), 42(*a*), 44(*a*), 46(*a*), 48(*a*), 50(*a*), 52(*a*), 54(*a*) arranged on the other side of the double-sided board opposite each corresponding one half λ printed circuit board radiating element 36, 38, 40, 42, 44, 46, 48, 50, 52, 54. The collinear microstrip printed circuit board means 32 has a second plurality of one half λ printed circuit board radiating elements 56, 58, 60, 62, 64, 66, 68, 70, 72, 74 collinearly arranged on one side 34(*b*) of the double-sided board 34, and has a respective section of microstrip transmission lines referred to in FIGS. 2(*a*) as 56(*a*), 58(*a*), 60 (*a*), 62(*a*), 64(*a*), 66(*a*), 68(*a*), 70(*a*), 72(*a*), 74(*a*) arranged on the other side 34(*b*) of the double-sided board 34 opposite each corresponding one half λ printed circuit board radiating element 56, 58, 60, 62, 64, 66, 68, 70, 72, 74. The collinear microstrip printed circuit board means 32 has two end quarter λ printed circuit board radiating elements 76, 78 collinearly arranged on one side 34(*b*) of the double-sided board 34 with respect to the corresponding one half λ printed circuit board radiating element 56, 58, 60, 62, 64, 66, 68, 70, 72, 74. The two end quarter λ printed circuit board radiating elements 76, 78 are respectively soft soldered to corresponding one half λ printed circuit board radiating elements 36, 54 through one aperture (not shown) and a corresponding aperture 80 shown in FIG. 2(*b*).

As shown in FIG. 2(*a*) and 2(*b*), the overall length of the collinear microstrip printed circuit board means 32 is 34.4, the location of each short hole is 1.007 inches, the thickness of the exposed dielectric is 0.093 inches, the width of the collinear microstrip printed circuit board means 32 is 0.725 inches, the edge-to-center dimension is 0.362 inches, and each of the short holes has a diameter of 0.036 inches. Any person skilled in the microstrip antenna art would appreciate that the dimension of the printed circuit board radiating elements and the section of section of microstrip transmission lines depend on a number of parameters, including the wavelength, and are determined using equations set forth in Antenna Engineering Handbook, 3rd Edition, by Richard C. Johnson (1993), hereby incorporated by reference. See in particular Table 42-2 and FIG. 42-4. See also "Linearly Polarized Microstrip Antennas", by Anders G. Derneryd, IEEE Transactions on Antennas and Propagation (November 1976), also hereby incorporated by reference. The scope of the invention is not intended to be limited to any particular dimension of the antenna, the printed circuit board radiating elements or the section of section of microstrip transmission lines.

Figure 3:
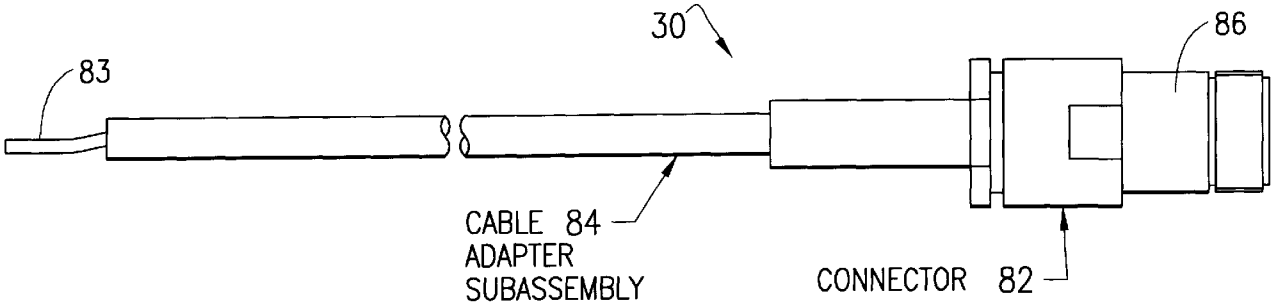
FIG. 3 is a diagram of a cable connector assembly of the microstrip collinear antenna shown in FIG. 1.

As shown in FIG. 3, the cable connector assembly means includes a connector 82, an inner insulated conductor member 83, and a cable adapter subassembly 84 arranged within the connector 82. As shown, the inner insulated conductor member 83 has a bend of 0.062 inches and the overall length after bending of the inner insulated conductor member conductor 83. The inner insulated conductor member 83 is soft soldered to a midpoint of the collinear microstrip printed circuit board means 32 at a section of microstrip transmission line referred to 36(*a*) in FIG. 1(*a*), as described below with respect to FIG. 7.

Figure 4:
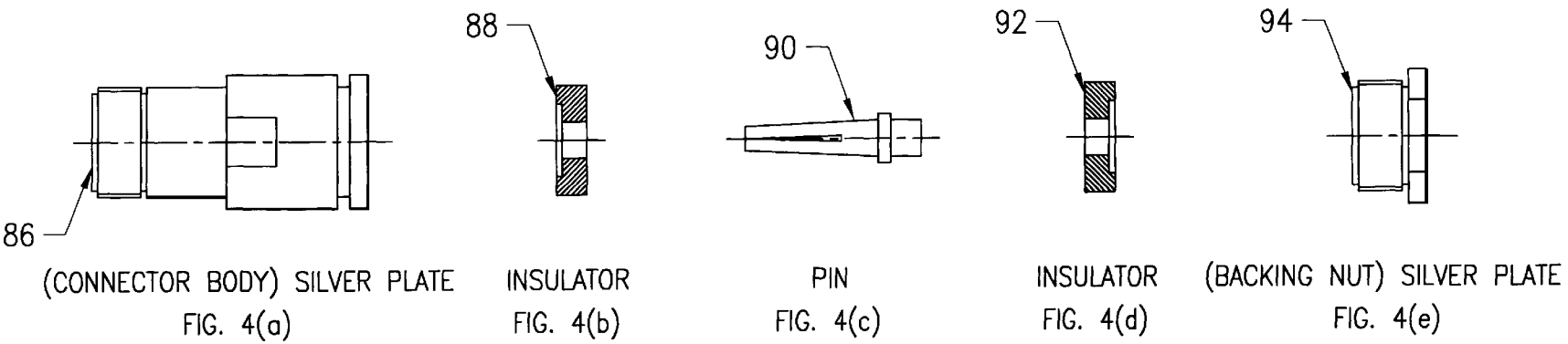
FIG. 4 includes FIGS. 4(*a*)–(*e*) which are diagrams of parts of a connector of the cable connector assembly shown in FIG. 3.

FIG. 4, including FIGS. 4(*a*)–(*d*), shows the connector 82 having a connector body 86, a first insulator 88, a pin 90, a second insulator 92 and a backing nut 94.

Figure 5:
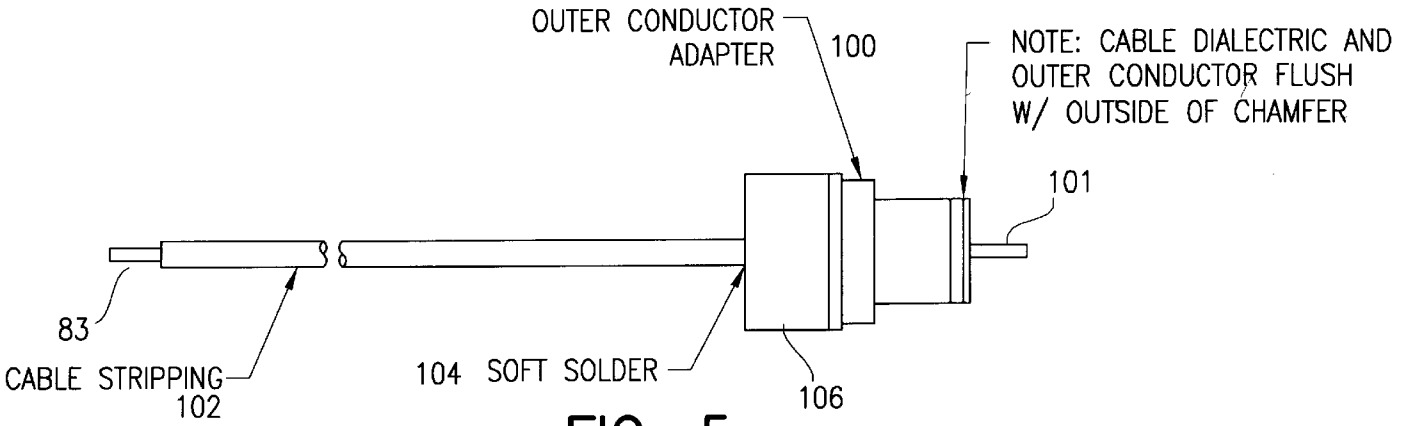
FIG. 5 is a diagram of a cable adapter subassembly of the microstrip collinear antenna shown in FIG. 1.

FIG. 5 shows the cable adapter subassembly having an outer conductor adaptor 100, end conductor 101, and a cable stripping 102 arranged therein with a soft solder 104. When assembled, the end conductor 101 is joined to pin 90 in FIG. 4(*c*) and has a dimension of 0.250 inches, as shown.

Figure 6:
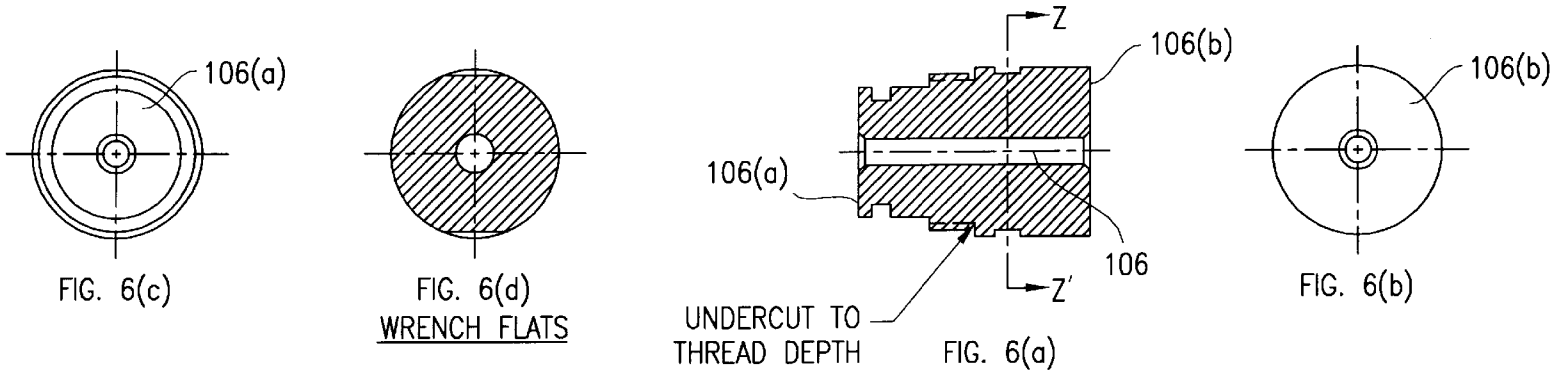
FIG. 6 includes FIGS. 6(*a*)–(*d*) which are diagrams of an outer conductor adapter of the cable adapter subassembly shown in FIG. 5.

FIG. 6 shows the outer conductor adaptor 100 having an outer conductor adaptor body 106 with first and second countersunk end openings 106(*a*) and (*b*). FIG. 6(*d*) shows a cross-section of the outer conductor adaptor body 106 along lines Z–Z'. FIG. 6 also shows the various dimensions of one embodiment of the outer conductor adaptor body 106.

Figure 7:
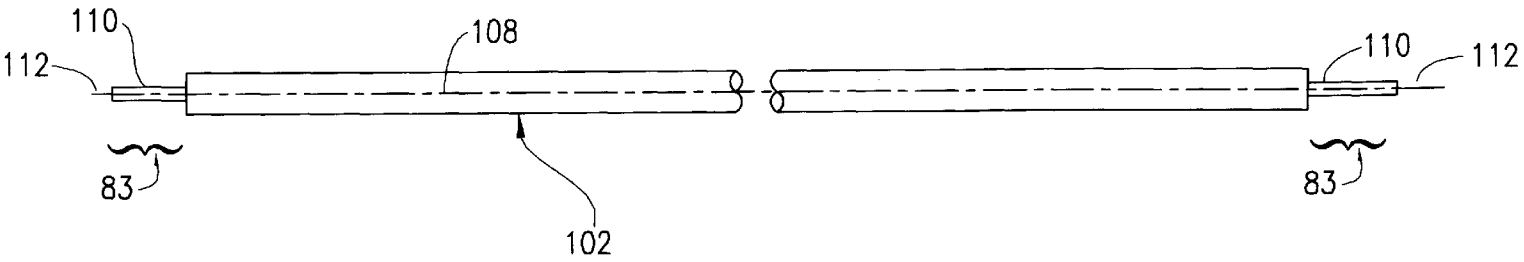
FIG. 7 is a diagram of a cable stripping of the cable adapter subassembly shown in FIG. 5.

FIG. 7 shows the cable stripping 102 having an outer metallic sheathing 108 and the inner insulated conductor member 83, which includes an cable insulation means 110 arranged therein, and an inner conducting wire 112 arranged within the insulation means 110. The inner conductor 86 in FIG. 3 includes the cable insulation means 110 and the inner conducting wire 112. As shown, the cable stripping is respectively 0.250 and 0.344 inches, and the length of the outer conductor is 21.00 inches.

As best shown in FIGS. 1 and 2, the outer metallic sheathing 108 is soft soldered along the entire edge joining the cable stripping 102 to a part of the section of the microstrip transmission lines referred to in FIG. 2(*a*) as 66(*a*), 68(*a*), 70(*a*), 72(*a*), 74(*a*) arranged on the other side 34(*a*) of the double-sided board 34 opposite each corresponding one half λ printed circuit board radiating element 56, 66, 68, 70, 72, 74. In addition, the inner conducting wire 112 is soldered at a midpoint of the part of the section of the microstrip transmission lines referred to in FIG. 2(*a*) as 64(*a*).

Figure 8:
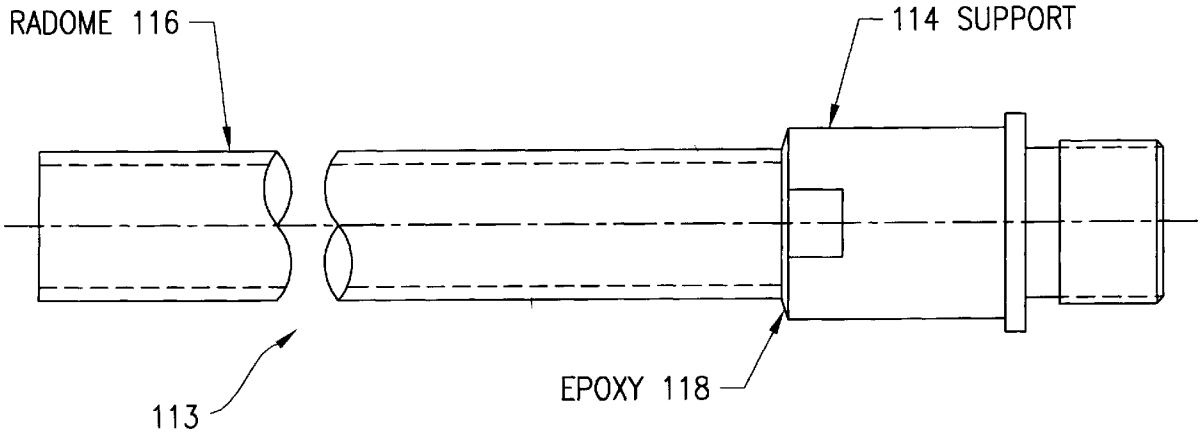
FIG. 8 is a diagram of a potting assembly of the microstrip collinear antenna shown in FIG. 1.

FIG. 8 shows a potting assembly generally indicated as 113 that includes a support 114, and a radome 116 affixed by epoxy 118 therein. As shown, the overall length of the antenna without the cap is 38.188 inches.

FIG. 9 shows the support 114 in greater detail, including helical grooves 115 and a moisture releasing aperture 114(*a*) best shown in FIG. 9(*c*) which allows the antenna to be mounted both vertically and horizontally. FIG. 9 also show various other dimensions used to design the support 114.

Figure 10:
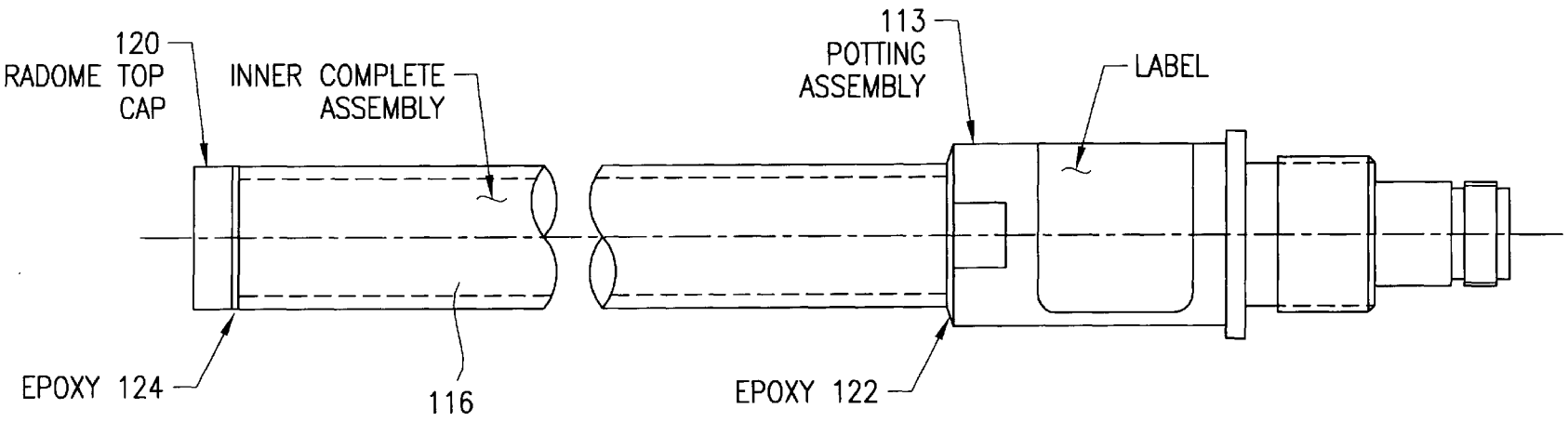
FIG. 10 is a diagram of a complete assembly of the microstrip collinear antenna shown in FIG. 1.

FIG. 10 shows a complete assembly of the microstrip collinear antenna, having the potting assembly 113, the radome 116 affixed therein by epoxy 122, a radome top 123 affixed to the radome 116 by epoxy 124.

FIG. 11 shows the radome 116 in greater detail having a length L equal to 36 13/16 inches, an outside diameter of 1 inch, and a wall diameter of 1/8 inch.

FIG. 12, including FIGS. 12(*a*) and 12(*b*), shows in greater detail the radome top 120 having a radome moisture releasing aperture 122.

In operation, a radio frequency (RF) signal is carried to the midpoint of the collinear array of radiating elements by a cable running from the bottom. The RF signal then spreads along the antenna and propagates out away from all the radiating elements in phase. The radiating elements are close spaced and on both sides of the circuit board for a high gain omnidirectional system of radiators operating in unison. In comparison, in other types antennas having linear arrays on circuit boards, one side of the circuit board would serve as a ground plate, the other side could contain a microstrip line and radiators.

Figure 13:
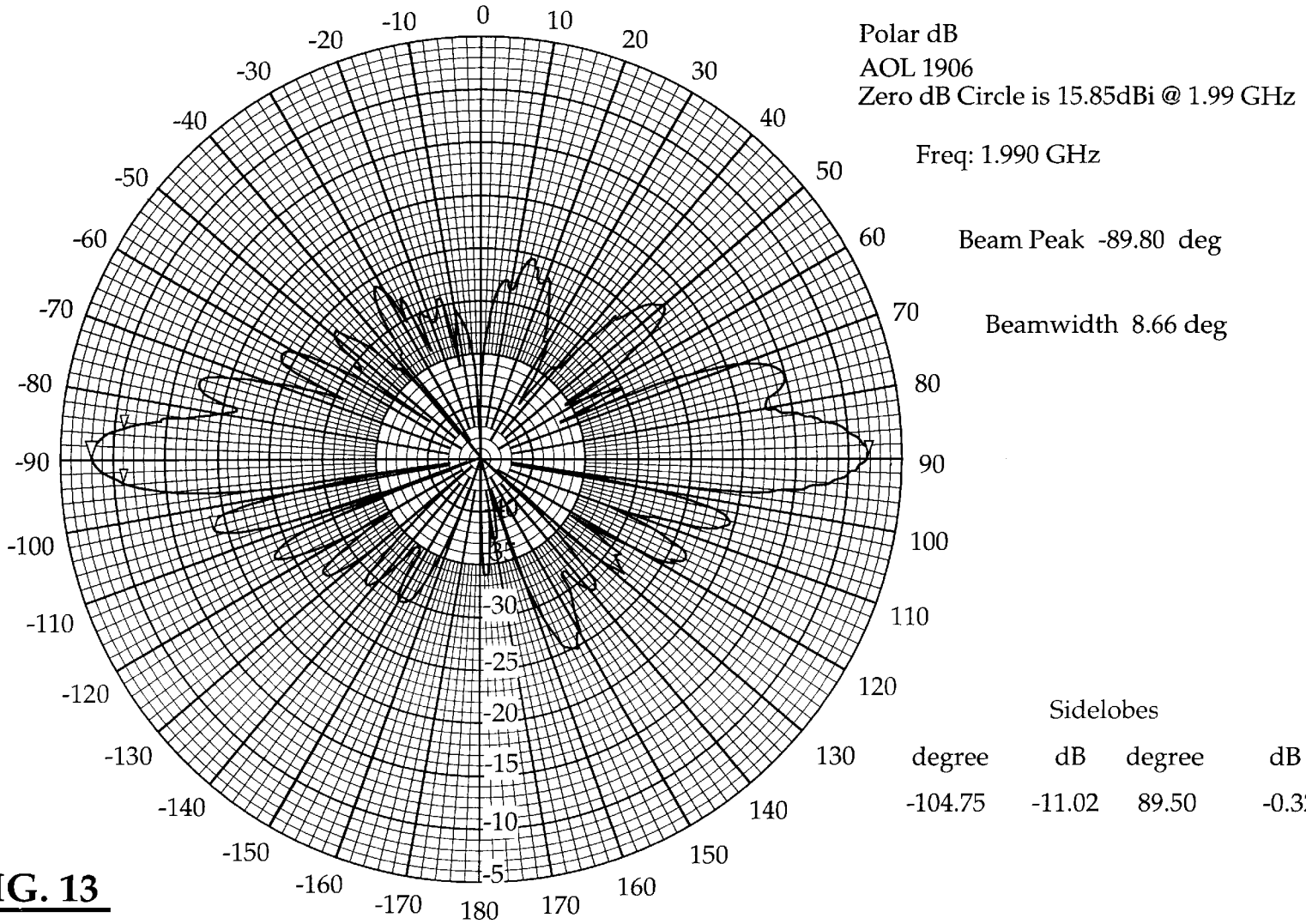
FIG. 13 is a polar dB plot at a frequency of 1.990 Gigahertz of the complete assembly shown in FIG. 10.

FIG. 13 shows a polar dB plot at 1.99 GHz for the microstrip collinear antenna of the present invention having a zero dB circle of 15.85 dBi, a beam peak of −89.80 degrees, a beamwidth of 8.66 degrees, and sidelobes of −104.75 degrees, −11.02 dB and 89.50 degrees, −0.32 dB.

Figure 14:
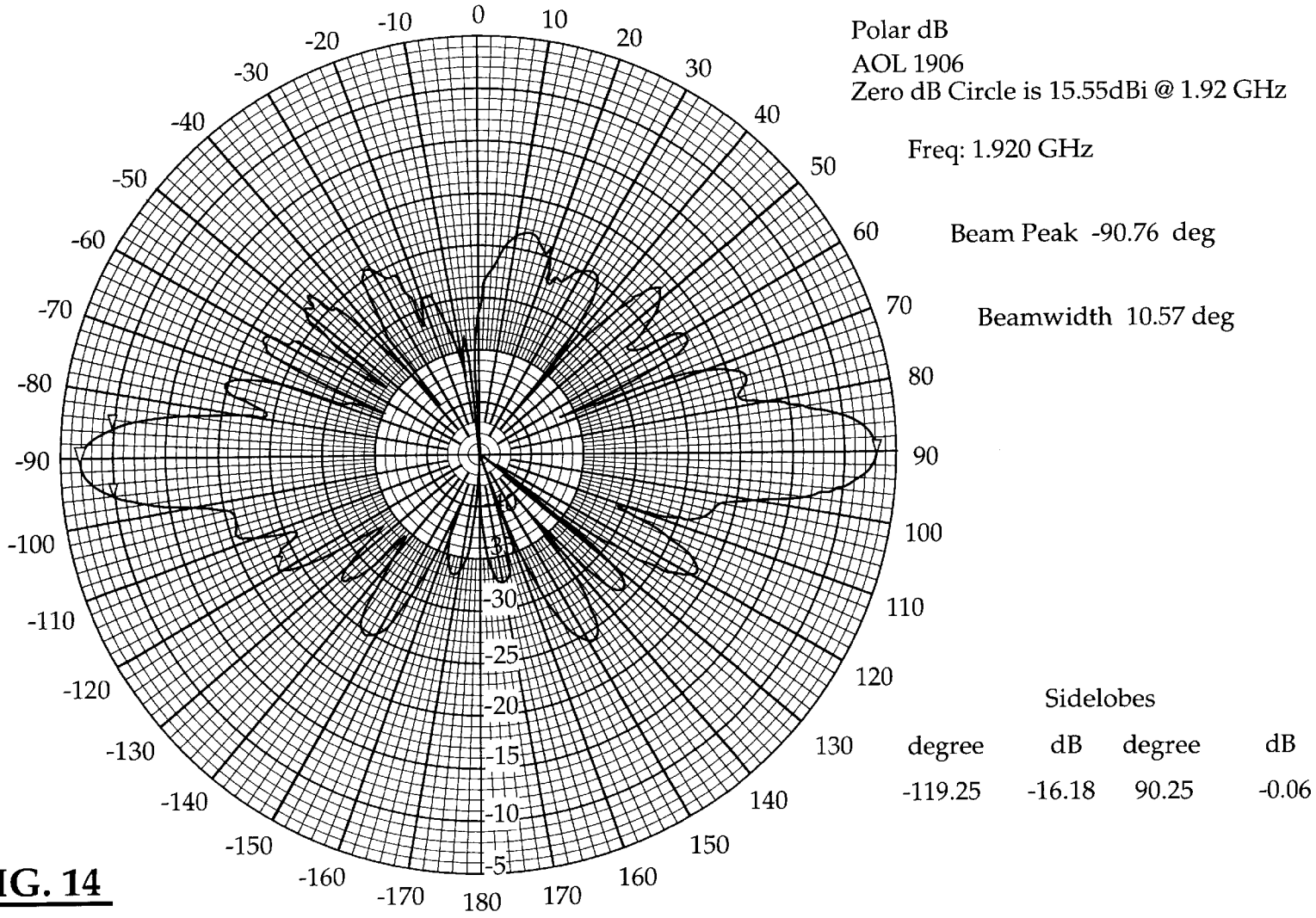
FIG. 14 is a polar dB plot at a frequency of 1.920 Gigahertz of the complete assembly shown in FIG. 10.

FIG. 14 shows a polar dB plot at 1.92 GHz for the microstrip collinear antenna of the present invention having a zero dB circle of 15.55 dBi, a beam peak of −90.76 degrees, a beamwidth of 10.57 degrees, and sidelobes of −119.25 degrees, −16.18 dB and 90.25 degrees, −0.06 dB.

Figure 15:
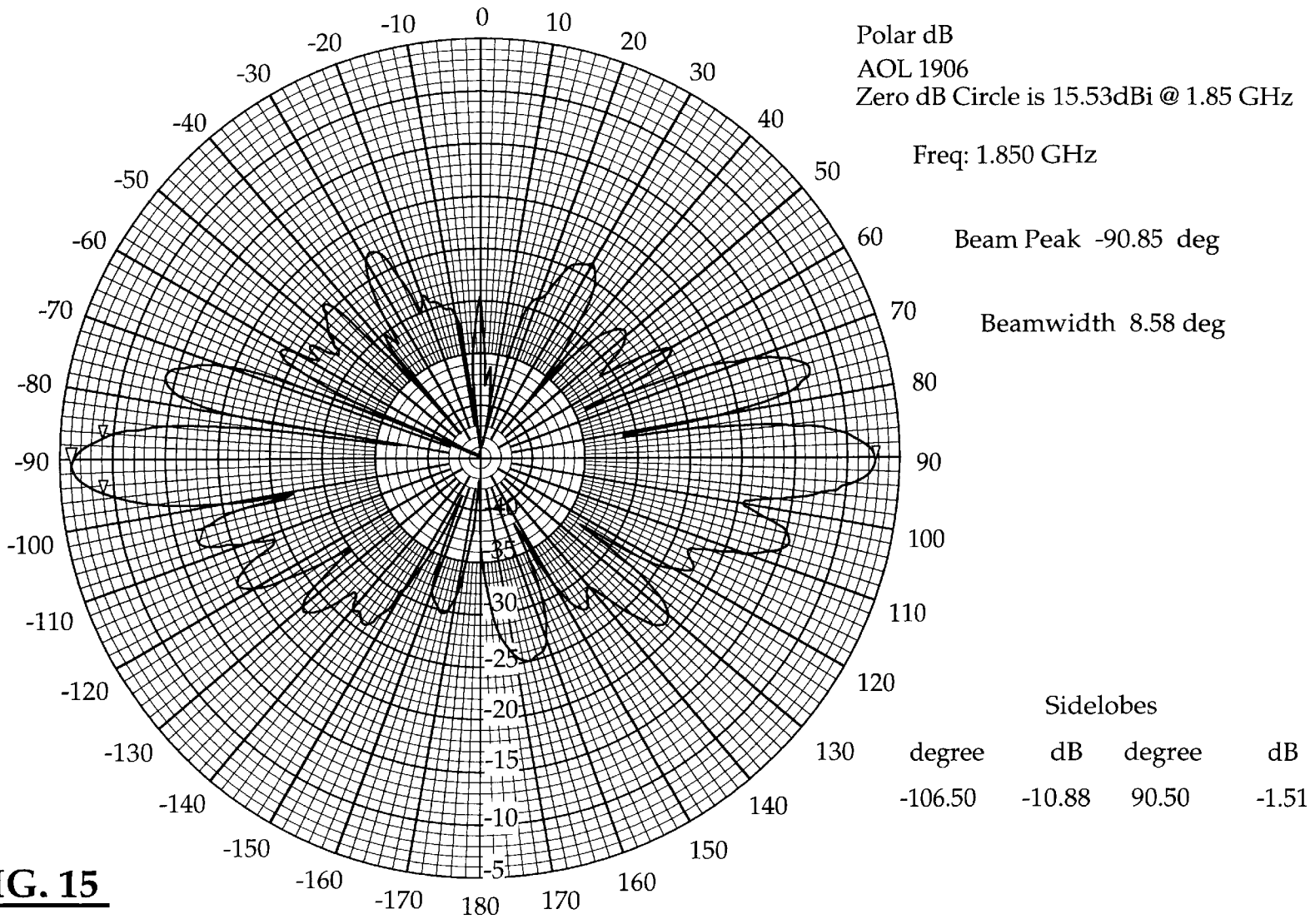
FIG. 15 is a polar dB plot at a frequency of 1.850 Gigahertz of the complete assembly shown in FIG. 10.

FIG. 15 shows a polar dB plot at 1.85 GHz for the microstrip collinear antenna of the present invention having a zero dB circle of 15.53 dBi, a beam peak of −90.85 degrees, a beamwidth of 8.58 degrees, and sidelobes of −106.50 degrees, −10.88 dB and 90.50 degrees, −1.51 dB.

The polar dB plots in FIGS. 13–15 indicate that the antenna of the present invention provides beam peaks having a location substantially at the 90 degrees horizon line.

Figure 16:
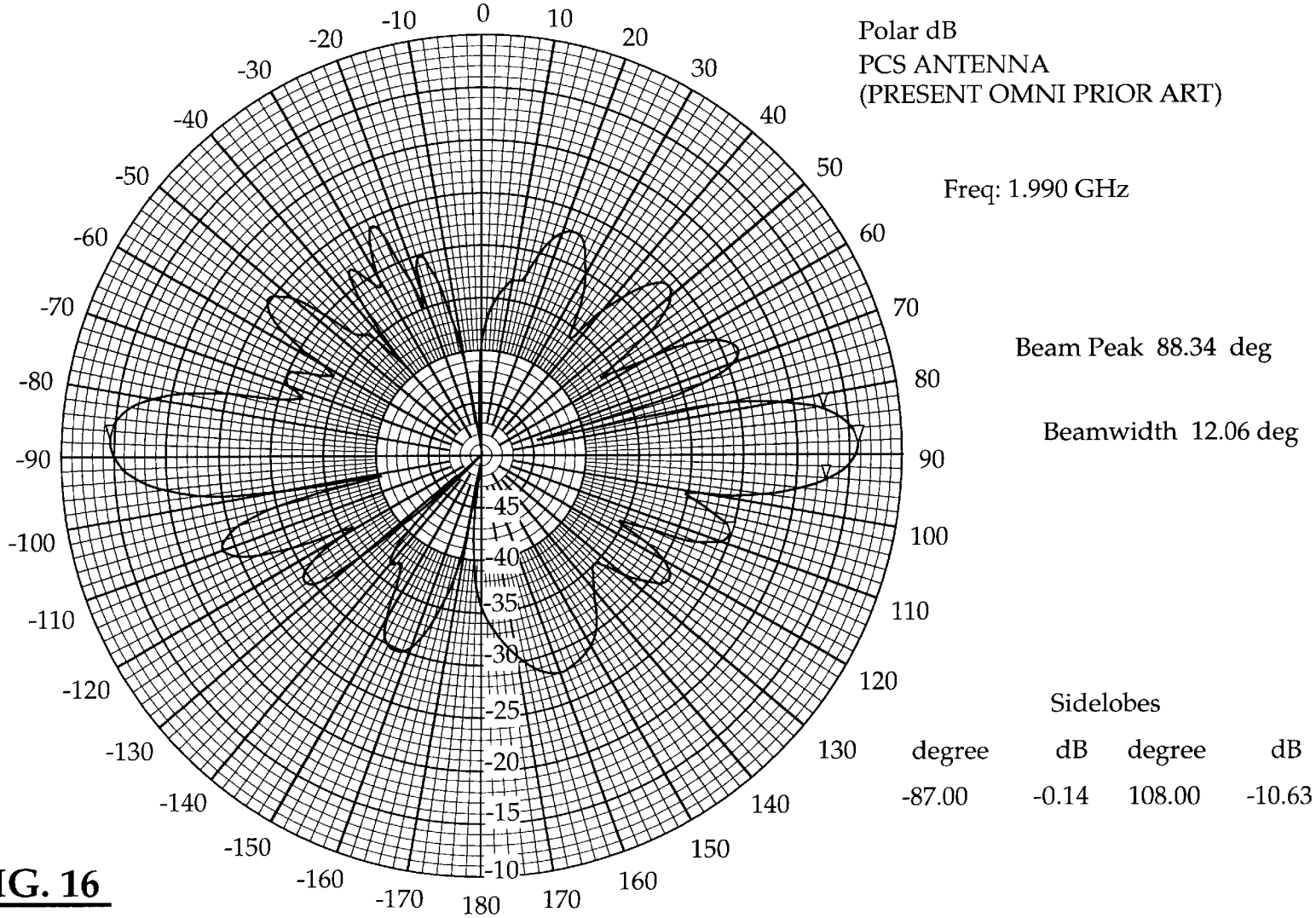
FIG. 16 is a polar dB plot at a frequency of 1.990 Gigahertz of a prior art PCS antenna.

FIG. 16 shows a polar dB plot at 1.99 GHz for the prior art antenna having a beam peak of −88.34 degrees, a beamwidth of 12.06 degrees, and sidelobes of −87.00 degrees, −0.14 dB and 108.00 degrees, −10.63 dB.

Figure 17:
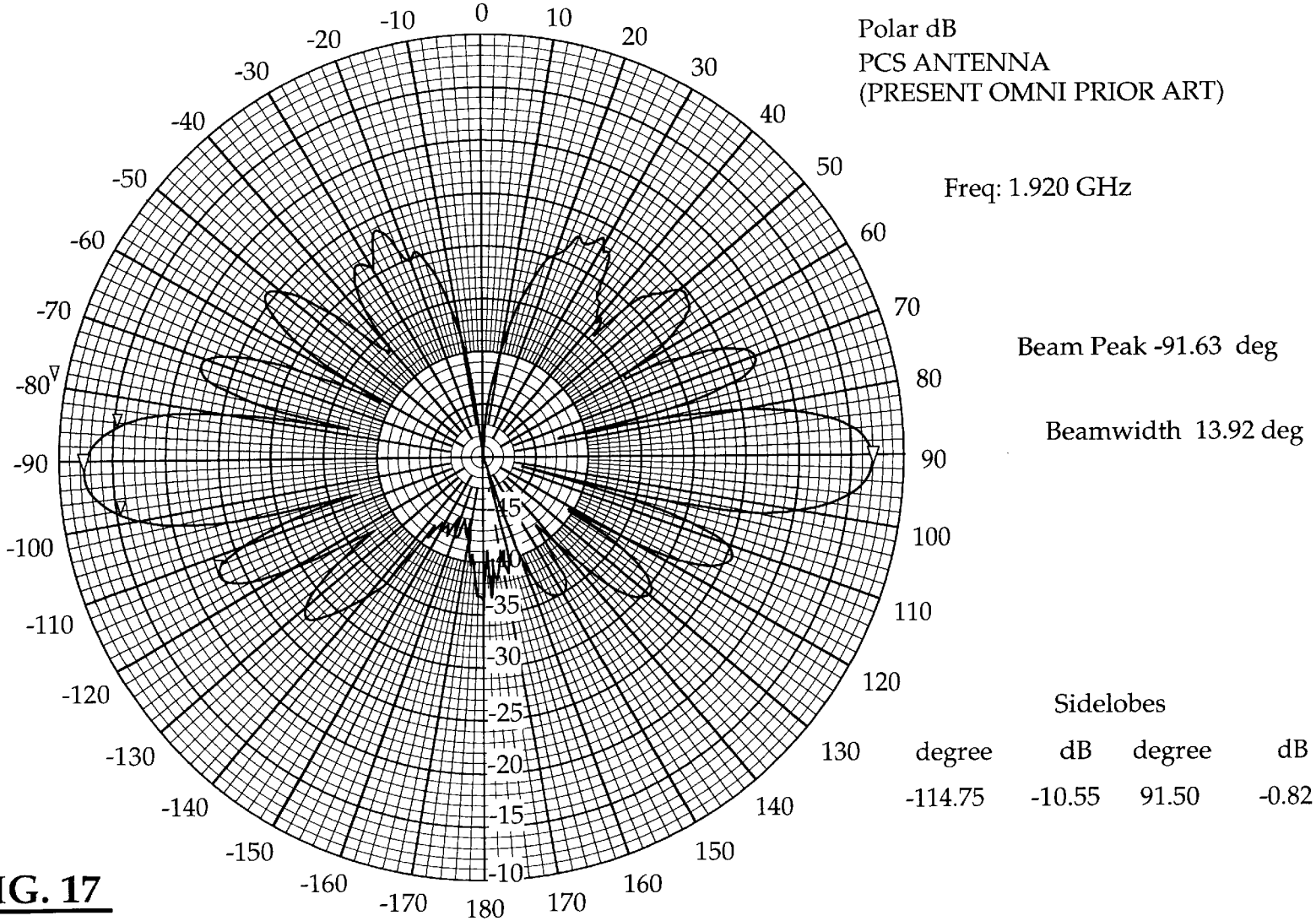
FIG. 17 is a polar dB plot at a frequency of 1.920 Gigahertz of the prior art PCS antenna.

FIG. 17 shows a polar dB plot at 1.92 GHz for the prior art antenna having a beam peak of −91.63 degrees, a beamwidth of 13.92 degrees, and sidelobes of −114.75 degrees, −10.55 dB and 91.50 degrees, −0.82 dB.

Figure 18:
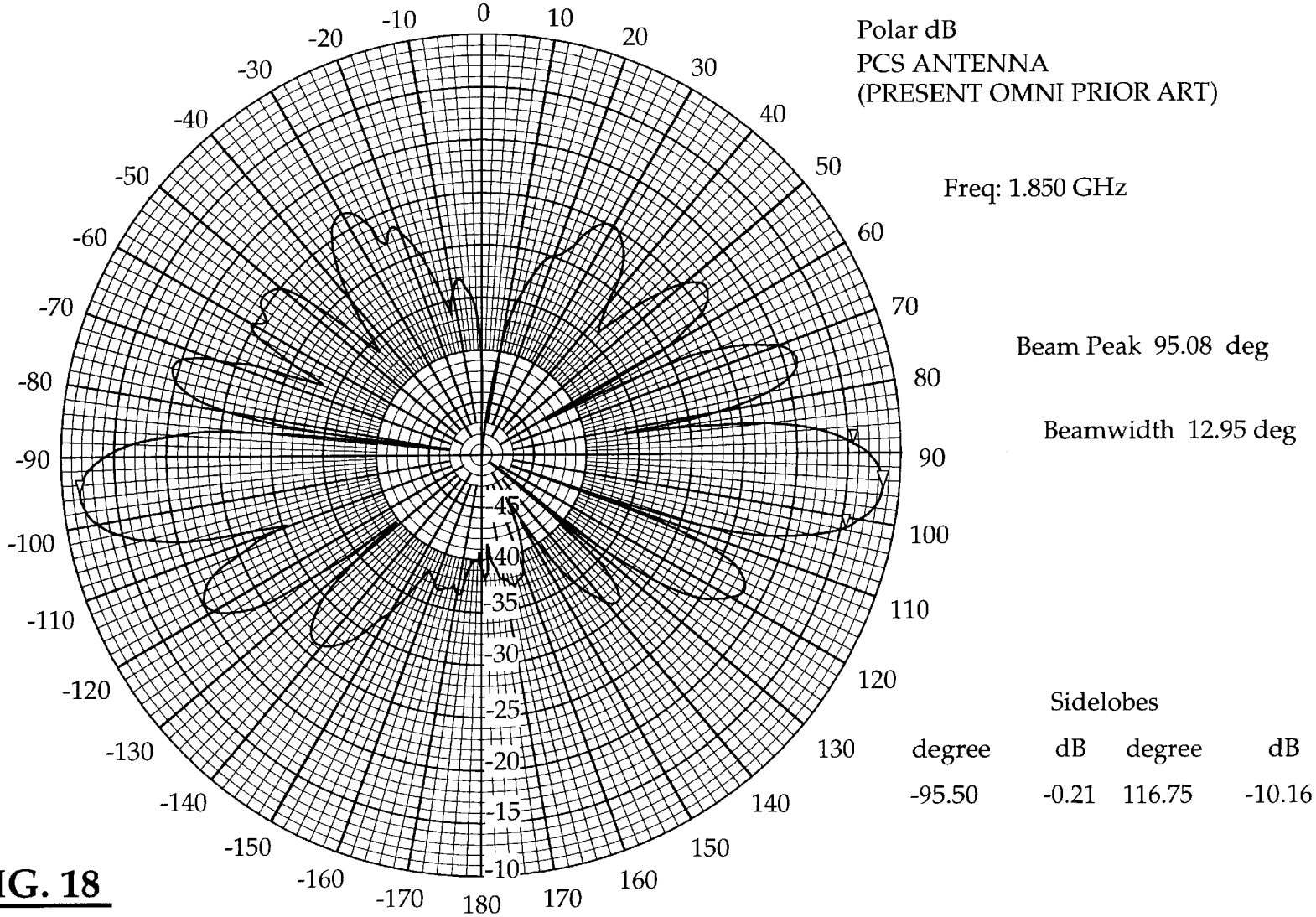
FIG. 18 is a polar dB plot at a frequency of 1.850 Gigahertz of the prior art PCS antenna.

FIG. 18 shows a polar dB plot at 1.85 GHz for the prior art antenna having a beam peak of −95.08 degrees, a beamwidth of 12.95 degrees, and sidelobes of −95.50 degrees, −0.21 dB and 116.75 degrees, −10.16 dB.

The polar dB plots in FIGS. 16–18 indicate that the antenna of the prior art provide a beam peak having a location deviating about 2–3 degrees from the horizon line.

Although the present invention has been described and discussed herein with respect to at least one embodiment, other arrangements or configurations may also be used that do not depart from the spirit and scope hereof. For example, the invention is shown and described with various dimensions which are provided as an example of one embodiment. The scope of the invention is not intended to be limited to any such dimensions.

What is claimed is:

1. An antenna, comprising:

cable connector assembly means, responsive to a radio signal, for providing a cable connector assembly radio signal; and a collinear microstrip double-sided printed circuit board means, each side having one half λ printed circuit board radiating elements and microstrip transmission lines collinearly and alternately arranged thereon, each one half λ printed circuit board radiating element on one side being arranged opposite a respective microstrip transmission line on an opposing side, responsive the cable connector assembly radio signal, for providing a collinear microstrip double-sided printed circuit board radio signal.

2. An antenna according to claim 1, wherein the cable connector assembly means includes a connector, and a cable adapter subassembly arranged within said connector.

3. An antenna according to claim 2, wherein the connector includes a connector body, a first insulator, a pin, a second insulator and a backing nut.

4. An antenna according to claim 2, wherein the cable adapter subassembly includes an outer conductor adaptor, and a cable stripping arranged therein with a soft solder.

5. An antenna according to claim 4, wherein the outer conductor adaptor includes an outer conductor adaptor body having first and second countersunk end openings.

6. An antenna according to claim 4, wherein the cable stripping includes an outer metallic sheathing, an insulation means arranged therein; and a wire arranged within the insulation means.

7. An antenna according to claim 1, wherein the antenna further comprises:

a support having apertures therein for protecting the collinear microstrip printed circuit board means; and a radome having an aperture affixed thereon.

8. An antenna according to claim 1, wherein the cable connector assembly means includes a connector, and a cable adapter subassembly arranged within said connector.

9. An antenna according to claim 8, wherein the cable adapter subassembly includes an outer conductor adaptor, and a cable stripping arranged therein with a soft solder.

10. An antenna according to claim 9, wherein the cable stripping includes an outer metallic sheathing, an insulation means arranged therein; and an inner conducting wire arranged within the insulation means.

11. An antenna according to claim 10, wherein the outer metallic sheathing is soft soldered along an entire edge joining the cable stripping to a part of the section of the microstrip transmission lines arranged on the other side of the double-sided board opposite each corresponding one half λ printed circuit board radiating element.

12. An antenna according to claim 10, wherein the inner conducting wire is soldered at a midpoint of a part of the section of the microstrip transmission lines.

13. An antenna according to claim 10, wherein the antenna is a personal service communication antenna.

14. An antenna according to claim 1, wherein the antenna is a personal service communication antenna.

15. An antenna according to claim 1, wherein the collinear microstrip printed circuit board means has two end quarter λ printed circuit board radiating elements collinearly arranged on one side of the double-sided board 34 with respect to the corresponding one half λ printed circuit board radiating element.

16. An antenna according to claim 15, wherein the two end quarter λ printed circuit board radiating elements are respectively soft soldered to corresponding one half λ printed circuit board radiating elements.

17. A personal service communication antenna, comprising:

cable connector assembly means, responsive to a radio signal, for providing a cable connector assembly radio signal;

a collinear microstrip printed circuit board means, responsive the cable connector assembly radio signal, for providing a collinear microstrip printed circuit board radio signal;

said collinear microstrip printed circuit board means comprising: a double sided circuit board, a plurality of one half λ printed circuit board radiating elements collinearly arranged on one side of the double-sided board, and a respective section of microstrip transmission lines arranged on the other side of the double-sided board opposite each corresponding one half λ printed circuit board radiating element;

the cable connector assembly means including a connector, and a cable adapter subassembly arranged within said connector;

the cable adapter subassembly including an outer conductor adaptor, and a cable stripping arranged therein with a soft solder, the cable stripping including an outer metallic sheathing, an insulation means arranged therein, and an inner conducting wire arranged within the insulation means;

the outer metallic sheathing being soft soldered along an entire edge joining the cable stripping to a part of the section of the microstrip transmission lines arranged on the other side of the double-sided board opposite each corresponding one half λ printed circuit board radiating element; and the inner conducting wire being soldered to a midpoint of the part of the section of the microstrip transmission lines.

* * * * *